US006129431A

United States Patent [19]

Hansen, Jr. et al.

[11] Patent Number: 6,129,431

[45] Date of Patent: Oct. 10, 2000

[54] MODULAR SHELVING SYSTEM

[76] Inventors: Harold R. Hansen, Jr., 33077 Aita Vista Dr., Evergreen, Colo. 80439; Charles P. Schreiner, 6169 Bayon Trail, Saugatuck, Mich. 49453

[21] Appl. No.: 08/773,196

[22] Filed: Dec. 30, 1996

[51] Int. Cl.[7] ..... A47F 5/08

[52] U.S. Cl. ..... 312/245; 211/90.01

[58] Field of Search ..... 211/87.01, 90.01, 211/90.02, 90.04, 94.01; 312/245, 246, 247, 351.1, 351.2, 351, 205; 108/106, 107, 108, 48, 42; 52/126.1, 126.3, 126.4, 243.1, 238.1, 239; 160/135, 351

[56] References Cited

U.S. PATENT DOCUMENTS

| | | | |
|---|---|---|---|
| 2,887,351 | 5/1959 | Allender | 312/245 |
| 2,927,666 | 3/1960 | Braviak | 108/107 X |
| 2,999,599 | 9/1961 | Jentzen | 312/245 X |
| 3,025,122 | 3/1962 | Millman | 312/245 |
| 3,317,261 | 5/1967 | Peterson et al. | 312/246 X |
| 3,335,532 | 8/1967 | Greenbie | 52/126.4 |
| 3,656,587 | 4/1972 | Siegel | 312/249.9 X |
| 3,865,248 | 2/1975 | Donovan et al. | 211/90.01 |
| 3,953,093 | 4/1976 | Hero | 312/245 |
| 4,662,131 | 5/1987 | Glockenstein | 52/126.4 |
| 5,212,918 | 5/1993 | Newhouse et al. | 52/238.1 X |

FOREIGN PATENT DOCUMENTS

| | | | |
|---|---|---|---|
| 8912412 | 12/1989 | WIPO | 312/245 |

*Primary Examiner*—Janet M. Wilkens
*Attorney, Agent, or Firm*—Marshall, O'Toole, Gerstein, Murray & Borun

[57] ABSTRACT

A modular shelving system includes one or more downward flanges fixed against a wall near a ceiling and a series of vertical sections that extend perpendicularly to the wall. Each vertical section is locked in place by positioning it against the wall and then raising it off the floor until an upward flange on the vertical section engages a downward flange. The wall section is raised off the floor through the use of a built-in riser in the base of the wall section. Once all the vertical sections are locked in place, shelves, cabinet faces, desktops, or the like are secured to the vertical sections to create the desired system. The riser in the base of the vertical section may consist of a foot on the bottom of a threaded rod that engages a threaded aperture in a frame within the vertical section. Hexagonal surfaces on the rod make it easier to apply the necessary force to rotate the rod and thereby raise or lower the foot with respect to the frame. After the vertical section is secured in place, a leveller cover nested within the base of the vertical section can be used to cover the riser and create a more finished look.

14 Claims, 5 Drawing Sheets

MODULAR SHELVING SYSTEM

TECHNICAL FIELD

The present invention relates generally to the field of building materials, and more particularly to modular furniture and shelving systems that can be used to form home office furniture, shelving, storage areas, and the like against bare walls.

BACKGROUND ART

As more people work from their homes, there is a growing need for adaptations of an existing room in the home—such as an extra bedroom or den—into functional office space. While it is common to convert such space into an office by merely adding a traditional desk, such conversions use the space inefficiently and often result in mismatched styles.

Better styling and use of space is available from custom or built-in furniture. The use of custom or built-in furniture involves problems of its own, however. Not only is custom or built-in furniture expensive, it does not allow flexibility for changing needs and is difficult or impossible to adapt and move to a different room.

Modular systems offer the desired efficiency and flexibility. Many modules systems, however, are complicated structures and are thus still impractical for commercialization. There remains a need, therefore, for a simple and effective modular system that can be built at a low cost.

SUMMARY OF THE INVENTION

The applicant has developed a new, simple modular system that includes one or more downward flanges fixed against a wall near the ceiling (or the top of the intended system), and a series of vertical sections that extend perpendicularly to the wall. Each vertical section is locked in place by positioning it against the wall and then raising it off the floor until an upward flange within the back edge of the vertical section engages a downward flange. The wall section can be easily raised off the floor through the use of a built-in riser in the base of the wall section. Once all the vertical sections are locked in place, shelves, cabinet faces, desktops, or the like can be secured to the vertical sections to create the desired system.

In one embodiment of the invention, the riser in the base of the vertical section consists of a foot on the bottom of a threaded rod that engages a threaded aperture in a frame within the vertical section. Hexagonal surfaces on the rod make it easier to apply the necessary force to rotate the rod and thereby raise or lower the foot with respect to the frame. After the vertical section is secured in place, a leveller cover nested within the base of the vertical section can be used to cover the riser and create a more finished look.

DESCRIPTION OF THE PREFERRED EMBODIMENT

Figure 1:
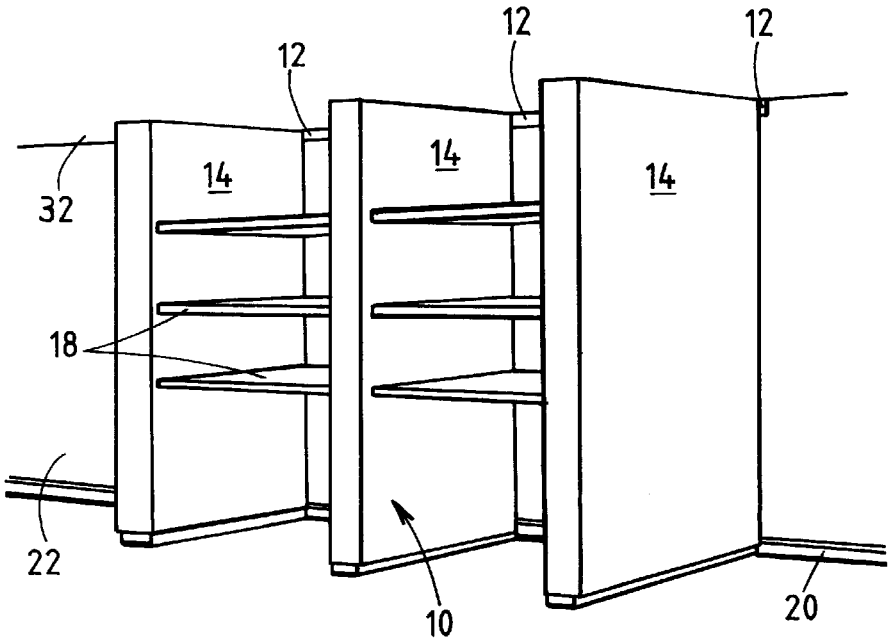
FIG. 1 is a perspective view of a modular system in accordance with the present invention.

FIG. 1 shows one arrangement of a modular wall system 10 in accordance with the present invention. The illustrated wall system includes a starter strip 12 and three vertic at sections 14. As shown, the system includes shelves 18, but the shelves could be replaced by cabinets, angled shelves, desk units, etc.

Figure 2:
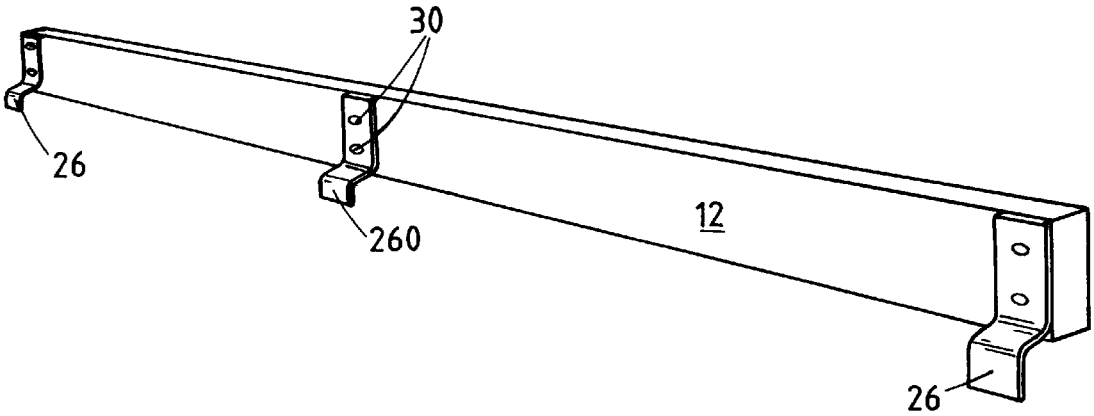
FIG. 2 is an enlarged perspective view of a starter strip from the system of FIG. 1.

The starter strip 12 is seen in more detail in FIG. 2. The strip is made of wood, plastic, or the like, and is approximately 2" high, ½" wide, and 4' long. The height of the starter strip can be varied for aesthetics. The thickness of the strip can similarly be varied, although it is preferable, for aesthetic purposes, if the thickness of the starter strip is roughly equal to the thickness of common baseboards 20 (FIG. 1). The width of the starter strip is at least equal to the width of the complete assembly 10, and could continue for the full length of the wall 22 against which the assembly is mounted.

The starter strip 12 has a downward flange 26 for each vertical section 14 in the assembly 10. The flanges are shown as being connected to the starter strip by fasteners 30. As an alternative to being attached by fasteners, the flange could be formed as an integral part of the starter strip. As illustrated, the flanges are about 3" wide. The preferred width for the flanges depends upon the structure of the vertical sections, as discussed below.

The starter strip 12 is positioned horizontally against the wall 22 against which the assembly 10 is to be mounted. The strip is fastened to the wall (preferably near the ceiling 32) in any conventional way, such as by screws (not shown) into studs behind the wall. The vertical position of the starter strip is determined by the height of the vertical sections to be used, as discussed below. When fastened to the wall, the downward flanges 26 are preferably spaced approximately 1" from the wall and extend downwardly approximately 1".

Figure 3:
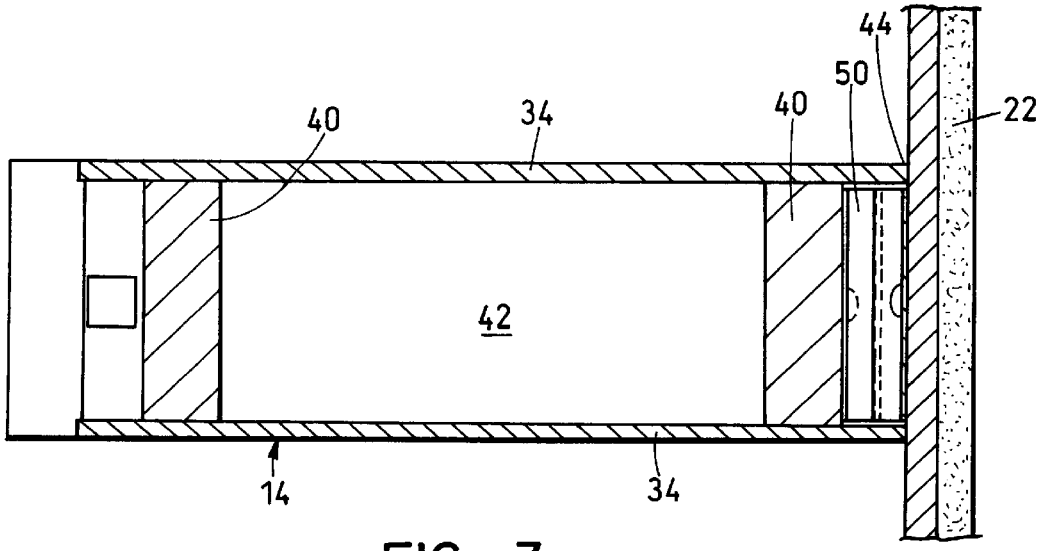
FIG. 3 is a plan view of a vertical section attached to a starter strip.
Figure 4:
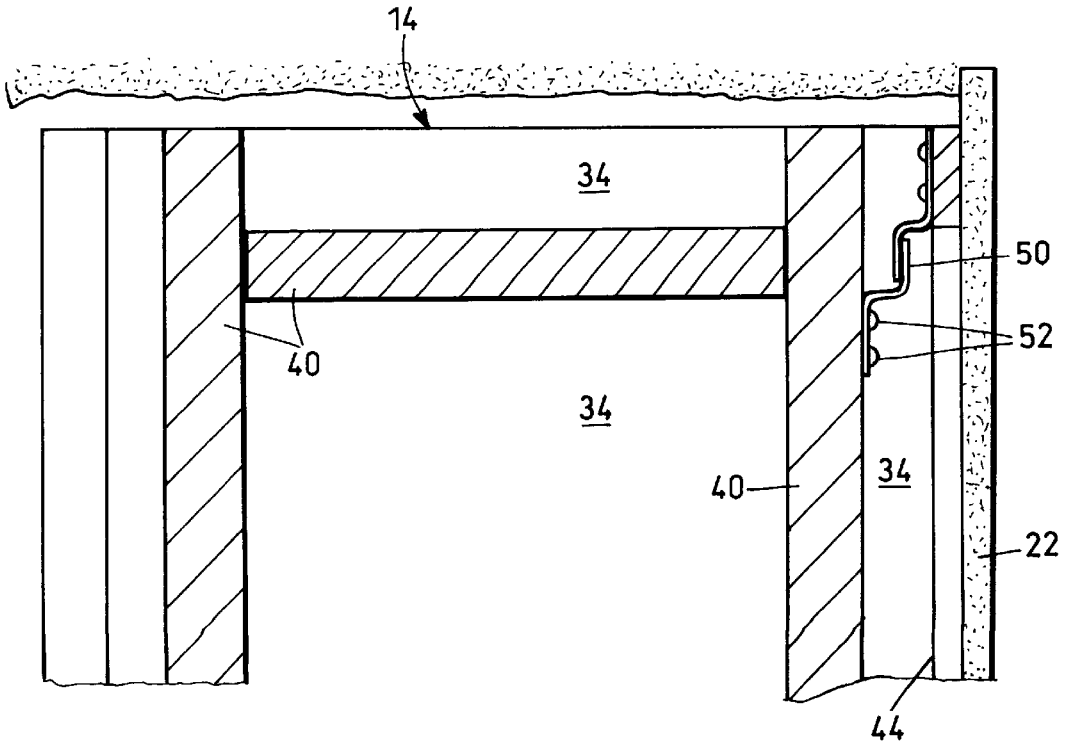
FIG. 4 is a sectional view of the top of the vertical section taken along lines 4—4 of FIG. 3.
Figure 5:
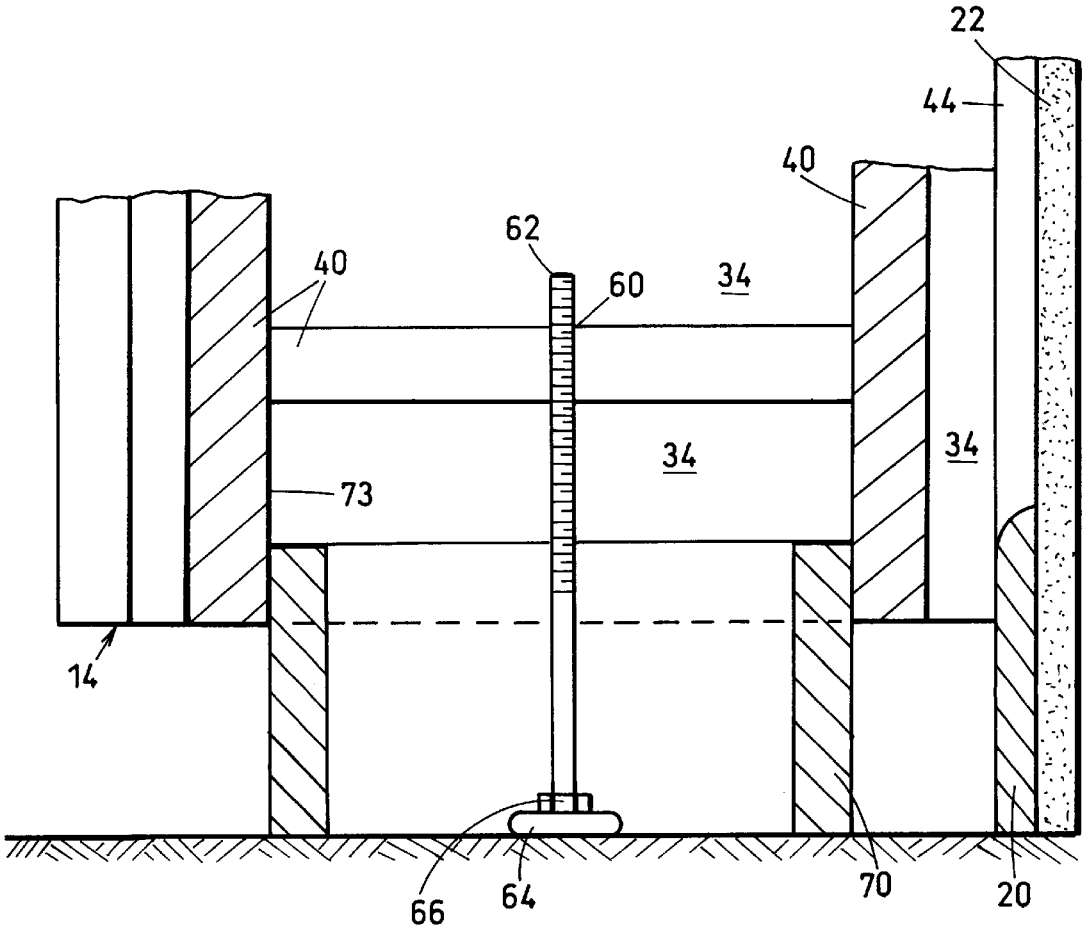
FIG. 5 is a sectional view of the bottom of the vertical section of FIG. 4.

As seen in FIGS. 3–5, each vertical section 14 has two opposed vertical faces 34. The faces are preferably made of high-pressure laminate and have a textured finish designed to match that of the walls of a typical home. Preferably, the faces are provided with apertures (not shown) to facilitate installation of shelving or the like. The arrangement of such apertures is conventionally known. The faces are preferably 7' 10" high, for creating floor-to-ceiling units in rooms with 8' ceilings. Taller faces could be used in rooms with higher ceilings. Shorter faces could also be used if less than a full floor-to-ceiling height is desired. The faces could be approximately 12" deep (for shelving), approximately 15" deep (for shelving, some office equipment, or general storage), or approximately 24" deep (for creating closets).

The faces 34 are supported by a frame 40, which is preferably made from 1×3" lumber or medium-density fiberboard creating an interior space 42 about 3" wide between the two faces. At an inside end 44, the faces extend horizontally approximately 1" beyond the frame and are integral with a front cap 36.

As seen in FIGS. 3 and 4, an upward flange 50 is mounted on the frame 40 in the interior space 42 between the faces 34 near the inside end 44. Preferably, the upward flange extends vertically approximately 1", and is spaced so that it has an upper end approximately 2" below the top of the faces and approximately ½" inwardly from the inside end. As shown, the upward flange is connected to the frame by fasteners 52. Alternatively, the flange could be formed as an integral part of the frame. As illustrated, the upward flange is about 3" wide, extending nearly full width of the interior space between the faces.

As seen in FIG. 5, the bottom of the vertical section 14 includes a vertical aperture 60 through the frame 40. The aperture is threaded to accommodate a threaded rod 62. A foot 64 is mounted to the bottom of the rod. The rod is also provided with hexagonal faces 66 that enable a person to easily grasp the rod and rotate it within the aperture. Alteratively, the rod could be provided with a keyway, or any other commonly known mechanism to facilitate rotation of the rod. The structure is preferably located near the bottom of the rod, just above the foot.

Rotating the rod 62 within the aperture 60 causes the foot 64 to move vertically with respect to the frame 40. Preferably, the foot can move at least from an upper position near the bottom of the faces 34 to a lower position at least about 3" below the bottom of the faces. A lock nut (not shown) could be added to enable the rod to be locked into any selected vertical position.

Figure 6:
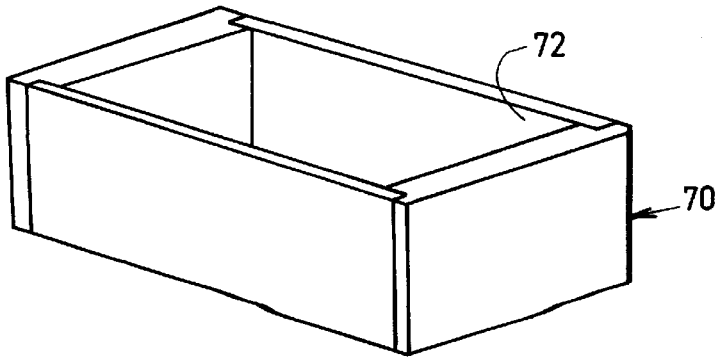
FIG. 6 is a orthogonal view of a leveler cover.

The bottom of the vertical section 14 is also provided with a leveler cover 70, seen in FIG. 6. The leveller cover is approximately 7" long, 3" wide, and 4" high, and preferably nests within the interior space 42 between the faces 34 at the bottom of the vertical section. The leveler cover has an interior volume 72 that accommodates the threaded rod 62, the foot 64, and the hexagonal faces 66. The leveler cover can be moved vertically with respect to the vertical section.

Each vertical section 14 is installed against the wall 22 by locking the upward flange 50 against its associated downward flange 26 on the starter strip 12. To do this, the foot 64 is first raised to an upper position near the bottom of the vertical section. This results in the overall height of the vertical section being several inches lower than the final intended height. The vertical section is then placed in its appropriate position with respect to the wall 22. The lower height of the vertical section allows it to be moved toward the wall without the downward flange hitting the upward flange. (This requires, of course, that the starter strip have been secured to the wall where the bottom edge of the downward flange is positioned at a height above the floor at least equal to the vertical distance from the upper position of the foot to the upper edge of the upper flange.) The vertical section should be positioned close enough to the wall so that at least an upper edge of the upward flange is closer to the wall than a lower edge of the downward flange.

In this position, the leveler cover 70 may naturally rest with its lower edge against the floor, blocking access to the threaded rod 62 and foot 64. Access can be gained simply by raising the cover into a recess 73 within the interior space 42 between the faces 34 of the vertical section 12. The vertical section may then be raised by turning the threaded rod while the foot engages the floor. As the frame 40 moves upwardly, the uppermost end of the upward flange 50 comes into contact with an arm 75 on the flange 26 as the lowermost end of the flange 26 comes into contact with an arm 51 on the upward flange 50, as seen in FIG. 4. This contact between the flanges provides a fixed limit on upward movement of the vertical section, and causes the upward flange to lock into position behind the downward flange 26, securing the vertical section to the wall. Contact between the inner edge 44 of the faces against the starter strip 12 can be used to limit movement toward the wall. After the vertical section is secured in position, the cover is released, dropping to the floor and concealing the foot and threaded rod.

After all the vertical sections are secured, the addition of shelves 18 or the like add further rigidity to the system. Decorative trim pieces can also be snapped into place to create a custom look.

Figure 7:
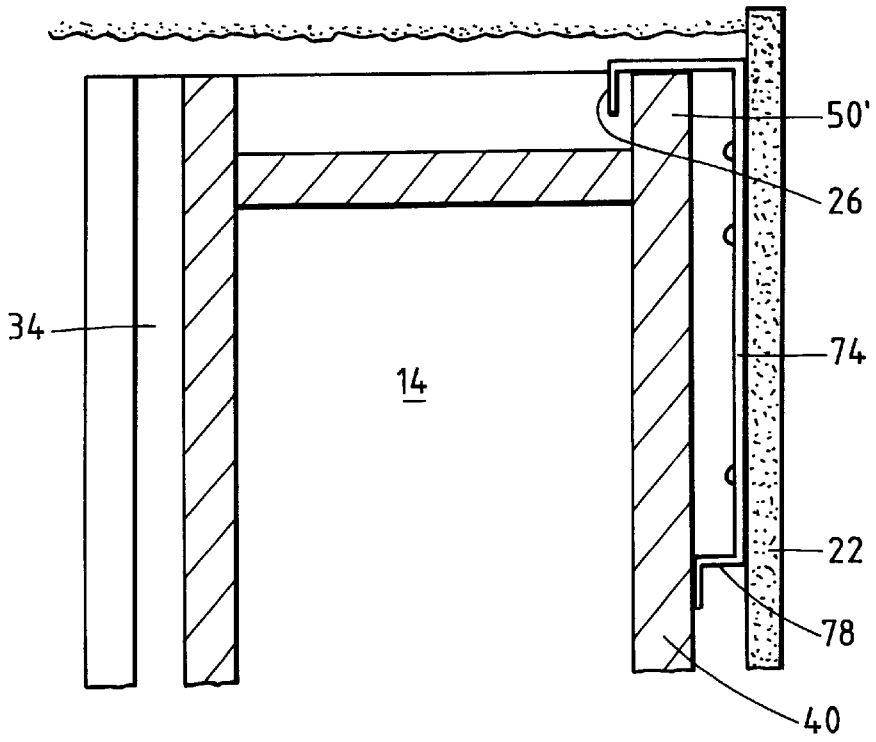
FIG. 7 is a sectional view of the top of a vertical section in a second embodiment of the invention.
Figure 8:
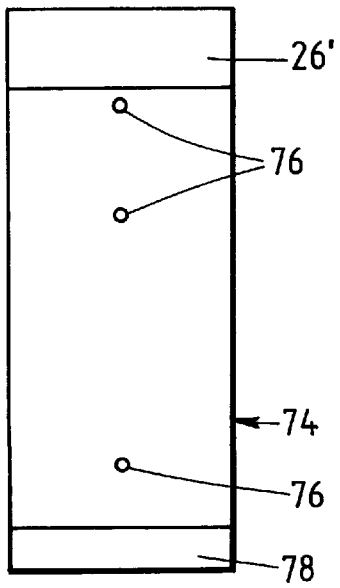
FIG. 8 is a front view of a wall bracket used in connection with the embodiment of the invention shown in FIG. 7.
Figure 9:
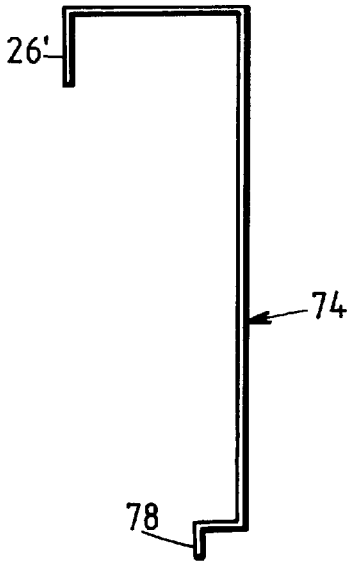
FIG. 9 is a side view of the wall bracket shown in FIG. 8.

FIGS. 7–9 disclose a second embodiment of the invention. In this embodiment, the, horizontal starter strip is replaced by a wall bracket 74. The wall bracket is preferably made of metal, and is approximately 3" wide and approximately 7" high. It has mounting holes 76 (FIG. 8) that allow it to be secured directly to the wall 22, as seen in FIG. 7. The wall bracket is shown with an optional spacer section 78. The spacer section engages the frame 40 on the vertical section 14 to prevent the inner ends of the faces 34 from impacting the wall.

In this embodiment of the invention, a portion of the frame 40 is used as the upward flange 50'. In order to engage this upward flange 50', the downward flange 26' on the wall bracket 74 extends approximately 2" from the wall 22, and is positioned so that the upper end of the downward flange is at a height approximately equal to the final intended height of the vertical section 14.

Figure 10:
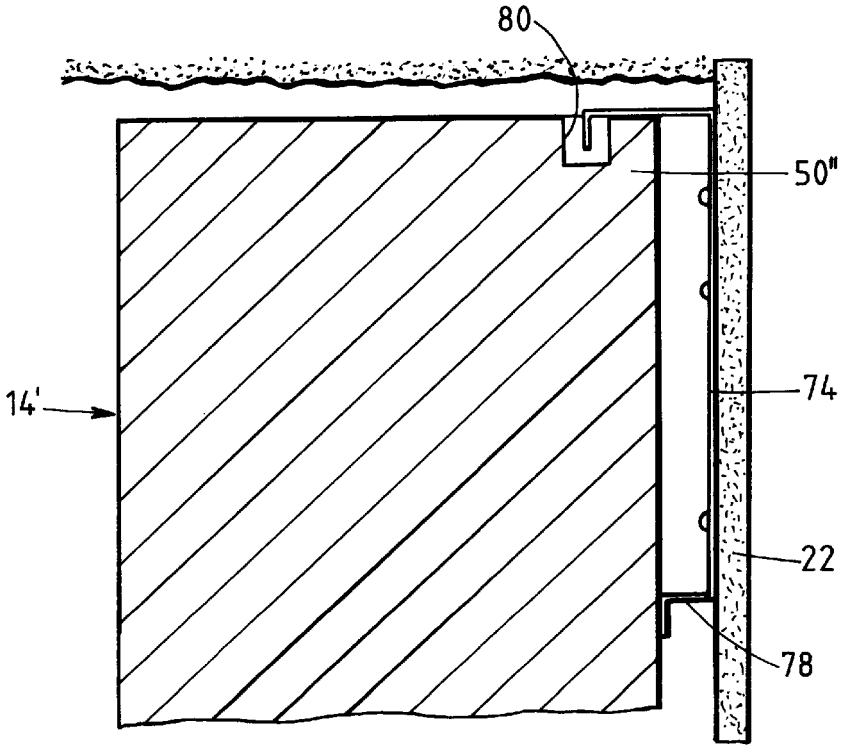
FIG. 10 is a sectional view of the top of a vertical section in a third embodiment of the invention.
Figure 11:
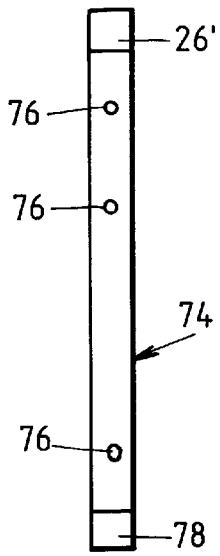
FIG. 11 is a front view of a wall bracket used in connection with the embodiment of the invention shown in FIG. 10.
Figure 12:
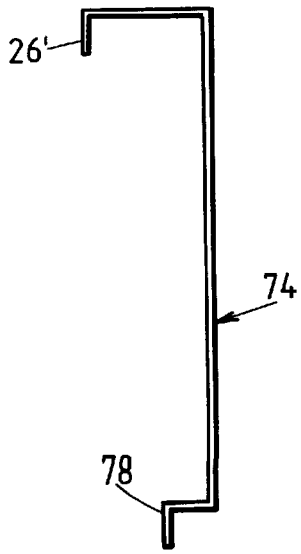
FIG. 12 is a side view of the wall bracket shown in FIG. 11.

It may sometimes be desirable to use a thin, solid vertical section, rather than a vertical section made with frame construction. FIGS. 10–12 disclose a third embodiment of the invention that utilizes a solid, 1" thick vertical section 14'. In this embodiment of the invention, a slot 80 in the top of vertical section creates an upward flange 50" at the upper inside end of the vertical section. This upward flange is engaged by a downward flange 26' on a 1" wide wall bracket 74'.

These descriptions are, of course, for the purpose of teaching those skilled in the art the best mode of carrying out the invention. Upon review of this descriptions, numerous modifications and alternative embodiments of the invention will be apparent to those skilled in the art.

What is claimed is:

1. A modular furniture system comprised of:

a downward flange;

means for attaching the downward flange to a wall;

a vertical section with vertical faces, an inner edge, an upward flange near the top of the inner edge between the vertical faces, a foot, and a riser comprising means for raising the faces with respect to the foot for engaging the upward flange with the downward flange; and limiting means on the flanges for limiting upward movement of the vertical section with respect to the downward flange.

2. The modular furniture system of claim 1, in which the downward flange is provided on a horizontal starter strip.

3. The modular furniture system of claim 1, in which the downward flange is provided on a horizontal starter strip as one of a series of downward flanges spaced at various positions across the starter strip.

4. The modular furniture system of claim 1, further comprising:

a horizontal starter strip on which the downward flange is provided as one of a series of downward flanges spaced at various positions across the starter strip; and a plurality of vertical sections, each with vertical faces and an inner edge, an upward flange near the top of the inner edge, a foot, and a riser.

5. The modular furniture system of claim 1, in which the riser comprises:

a threaded aperture on a frame separating the faces; and a vertical rod with threads engaging the threaded aperture for vertical movement with respect to the faces.

6. The modular furniture system of claim 1, in which:

the riser comprises a threaded aperture on a frame within the faces, a vertical rod extending upwardly from the foot with threads engaging the threaded aperture, and means for facilitating rotation of the vertical rod with respect to the aperture; and the system further comprises a leveler cover that nests within a recess in the bottom of the vertical section, has an interior volume that accommodates the rod and at least a portion of the foot, and is moveable vertically with respect to the faces.

7. The modular furniture system of claim 1, in which the downward flange comprises a horizontal arm.

8. The modular furniture system of claim 1, in which the upward flange comprises a horizontal arm.

9. A method of installing floor-to-ceiling modular furniture against a wall, the method comprising the steps of:

providing a downward flange, and providing a vertical section with an inner edge, an upward flange near the top of the inner edge, and a foot;

fixing the downward flange to a wall, with the flange spaced at a distance from the wall;

positioning the vertical section with the inner edge near the wall, and an uppermost edge of the upward flange laterally between the downward flange and the wall; and moving the vertical section upwardly with respect to the foot toward a fixed upper limit to engage the upward and downward flanges.

10. The method of claim 9, in which the downward flange is fixed to a horizontal starter strip and the starter strip is fixed to the wall.

11. The method of claim 9, further comprising the step of:

lowering a leveler cover over at least a portion of the foot after the flanges have been engaged.

12. The method of claim 9, which the downward flange comprises a horizontal arm.

13.The method of claim 9, in which the upward flange comprises a horizontal arm.

14. The method of claim 9, in which the vertical section is moved upwardly from a position in which the uppermost edge of the upward flange is below a lowermost edge of the downward flange.

* * * * *

UNITED STATES PATENT AND TRADEMARK OFFICE

CERTIFICATE OF CORRECTION

PATENT NO. : 6,129,431

DATED : October 10, 2000

INVENTOR(S) : Hansen, Jr. et al.

It is certified that error appears in the above-identified patent and that said Letters Patent is hereby corrected as shown below:

Claim 12, Column 6, Line 20, between "," and "which" insert the word - -in- -

Signed and Sealed this

Eighth Day of May, 2001

*Attest:*

Nicholas P. Godici

NICHOLAS P. GODICI

*Attesting Officer*

*Acting Director of the United States Patent and Trademark Office*